US007395834B1

(12) United States Patent
Lawson et al.

(10) Patent No.: US 7,395,834 B1
(45) Date of Patent: Jul. 8, 2008

(54) HYDRANT BOX

(75) Inventors: David L. Lawson, North East, PA (US); Robert K. Dimmer, Dunkirk, NY (US)

(73) Assignee: Zurn Industries, LLC, Erie, PA (US)

( * ) Notice: Subject to any disclaimer, the term of this patent is extended or adjusted under 35 U.S.C. 154(b) by 385 days.

(21) Appl. No.: 11/086,977

(22) Filed: Mar. 22, 2005

Related U.S. Application Data

(60) Provisional application No. 60/556,908, filed on Mar. 26, 2004.

(51) Int. Cl.
*F16L 5/00* (2006.01)

(52) U.S. Cl. ..... 137/359; 137/360

(58) Field of Classification Search ..... 137/359, 137/360; 52/62
See application file for complete search history.

(56) References Cited

U.S. PATENT DOCUMENTS 3,565,103 A * 2/1971 Maselek ..... 137/360
5,964,246 A * 10/1999 Meeker ..... 137/360
6,085,780 A * 7/2000 Morris ..... 137/377
6,129,109 A * 10/2000 Humber ..... 137/360
6,435,206 B1 * 8/2002 Minnick ..... 137/360
7,077,156 B1 * 7/2006 Humber et al. ..... 137/360
2004/0194395 A1 10/2004 Ball

OTHER PUBLICATIONS

Zurn Industries, Inc. "Ecolotrol Ceramic Disc Wall Hydrant (Z-1330-75)", Product Specification, Apr. 26, 2002 (1 page).
Zurn Industries, Inc. "Ecolotrol Ceramic Disc Wall Hydrant (Z-1320-62)", Product Specification, Apr. 25, 2002 (1 page).

* cited by examiner

*Primary Examiner*—John Fox
(74) *Attorney, Agent, or Firm*—The Webb Law Firm

(57) ABSTRACT

The present invention is a wall hydrant box having a unitary front plate welded onto a front portion of the wall hydrant box. The unitary front plate is sufficiently sized to allow a ring or any other such structure to be mounted to a rear portion of the wall hydrant box, so that the structure is obscured when the wall hydrant is viewed from the front. The unitary front plate also provides a uniform and aesthetic look to the front of the wall hydrant box.

7 Claims, 7 Drawing Sheets

HYDRANT BOX

CROSS REFERENCE TO RELATED APPLICATIONS

This application claims the benefit of U.S. Provisional Patent Application No. 60/556,908, filed Mar. 26, 2004, entitled "Hydrant Box", the disclosure of which is hereby incorporated by reference.

BACKGROUND OF THE INVENTION

1. Field of the Invention

The present invention is directed to a wall hydrant and, more specifically, to an encased wall hydrant having a unitary front plate.

2. Description of Related Art

Wall hydrants are designed for commercial applications such as office buildings, institutions, hospitals, malls, retail outlets, and schools. Such wall hydrants may be encased within a box, such as a stainless steel box that is mounted within a wall. The box includes a hinged cover with an operating key lock. A face plate surrounding the cover is welded onto the box. Previous face plates did not sufficiently extend past the edge of the box to conceal any portion of a ring that was attached to the back of the box. Therefore, to overcome this deficiency, the prior art involved welding a frame along the outside edges of the existing faceplate. The frame, in conjunction with the existing face plate, provided sufficient coverage to conceal the ring and allow the frame to cover any exposed areas of a hole in the wall into which the wall hydrant was mounted.

A prior art wall hydrant box 10 is illustrated in FIG. 1. The prior art wall hydrant box includes a box 12, a cover 14, a lock 16, a face plate 18, and a frame 20. The box 12 is desirably of stainless steel construction and designed to accommodate a wall hydrant therein. The cover 14 is hinged to the box 12 and includes the lock 16 for locking the cover 14 to the box 12. The face plate 18, which is typically 6¾ inch square, is welded to the front of the box 12, so that the cover 14 is surrounded by and flush with the face plate 18. The frame 20, which typically will result in an extended face plate of 10 inch square, is welded along the outer surface of the face plate 18 at the flush weld point 21 to increase coverage of the front of the wall hydrant box 10 to a greater extent than if only the face plate 18 were to be utilized. The frame 20 is essentially a 10 inch square plate with a 6¾ inch square hole cut out that receives face plate 18, which is welded thereto.

The welding of the additional frame 20 results in weld lines, which detract from the aesthetic quality of the face plate 18. Additionally, the process of welding requires additional work time to be expended.

Accordingly, what is needed and has not heretofore been developed is a wall hydrant having a unitary front plate, eliminating the need for welding two frames together.

SUMMARY OF THE INVENTION

The present invention is directed to a wall hydrant within a wall hydrant box having a unitary front plate welded onto a front portion of the wall hydrant box. The unitary front plate is sufficiently sized to allow a ring or any other such structure to be mounted to a rear portion of the wall hydrant box, so that the structure is obscured when the wall hydrant is viewed from the front.

The present invention is also directed to a method of replacing a face plate of a wall hydrant box with a unitary frame including the steps of drilling holes into spot welds of the face plate; removing the face plate from the wall hydrant box; positioning the unitary frame adjacent to the front side of the wall hydrant box; and welding the unitary frame to the front side of the wall hydrant box. The method can also include the steps of positioning a ring adjacent to the rear side of the wall hydrant box; and welding the ring thereto. The unitary frame is sufficiently sized so as to obscure the ring when viewed from the front side of the box.

The present invention does not require the use of welding any frame to the existing face plate of the wall hydrant box. Instead, the unitary front plate is substituted for the face plate and the frame, thereby providing a uniform and aesthetic look to the front of the wall hydrant box.

Further details and advantages of the present invention will become apparent upon reading the following detailed description in conjunction with the accompanying drawings.

DETAILED DESCRIPTION OF THE INVENTION

Figure 1:
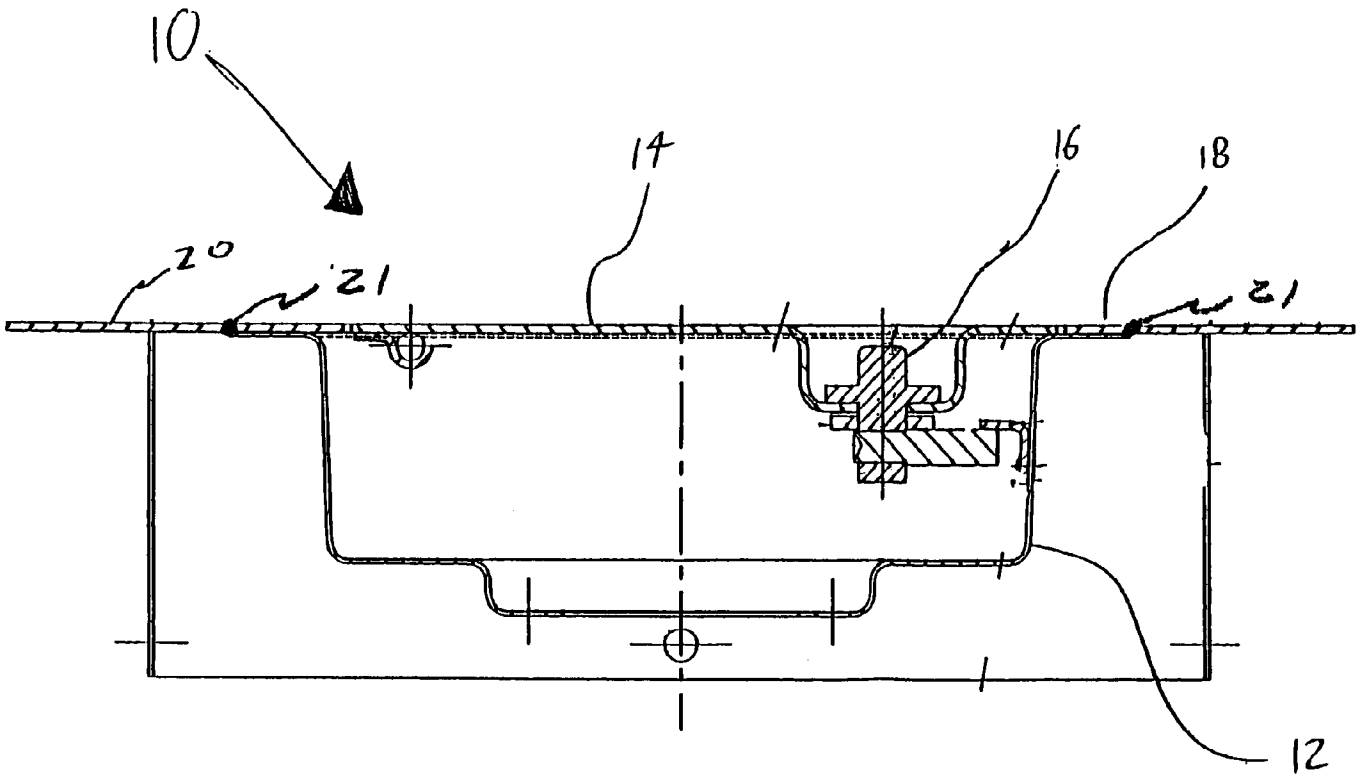
FIG. 1 (PRIOR ART)
FIG. 1 is a cross-sectional side view of a prior art wall hydrant box having a frame welded to a face plate.

For purposes of the description hereinafter, the spatial or directional terms, such as "front," "rear," and derivatives thereof, shall relate to the invention as it is oriented in the drawing figures. However, it is to be understood that the invention may assume various alternative variations, except where expressly specified to the contrary. It is also to be understood that the specific apparatus illustrated in the attached drawings, and described in the following specification, is simply an exemplary embodiment of the invention. Hence, specific dimensions and other physical characteristics related to the embodiment disclosed herein are not to be considered as limiting. The present invention will be described with reference to the accompanying figures, wherein like reference numbers correspond to like elements throughout.

Figure 2:
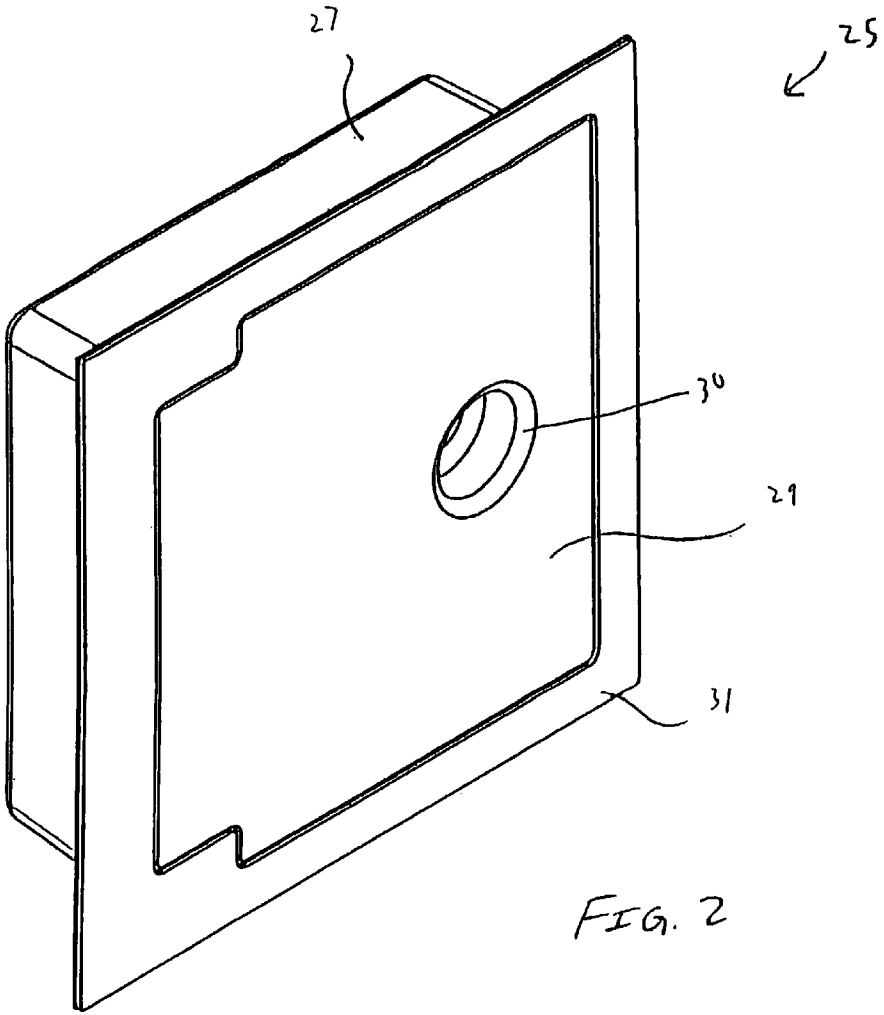
FIG. 2 is a front perspective view of the wall hydrant box in accordance with the present invention.

With reference to FIG. 2, a wall hydrant box 25 includes a box 27, a cover 29 and a face plate 31. Box 27 may be constructed of stainless steel and is designed to accommodate a wall hydrant therein. Cover 29 is hinged (not shown) to allow access to the wall hydrant and includes an operating key lock 30. Cover 29 may also include a descriptive stamp thereon such as "WATER" or the like.

Figure 3:
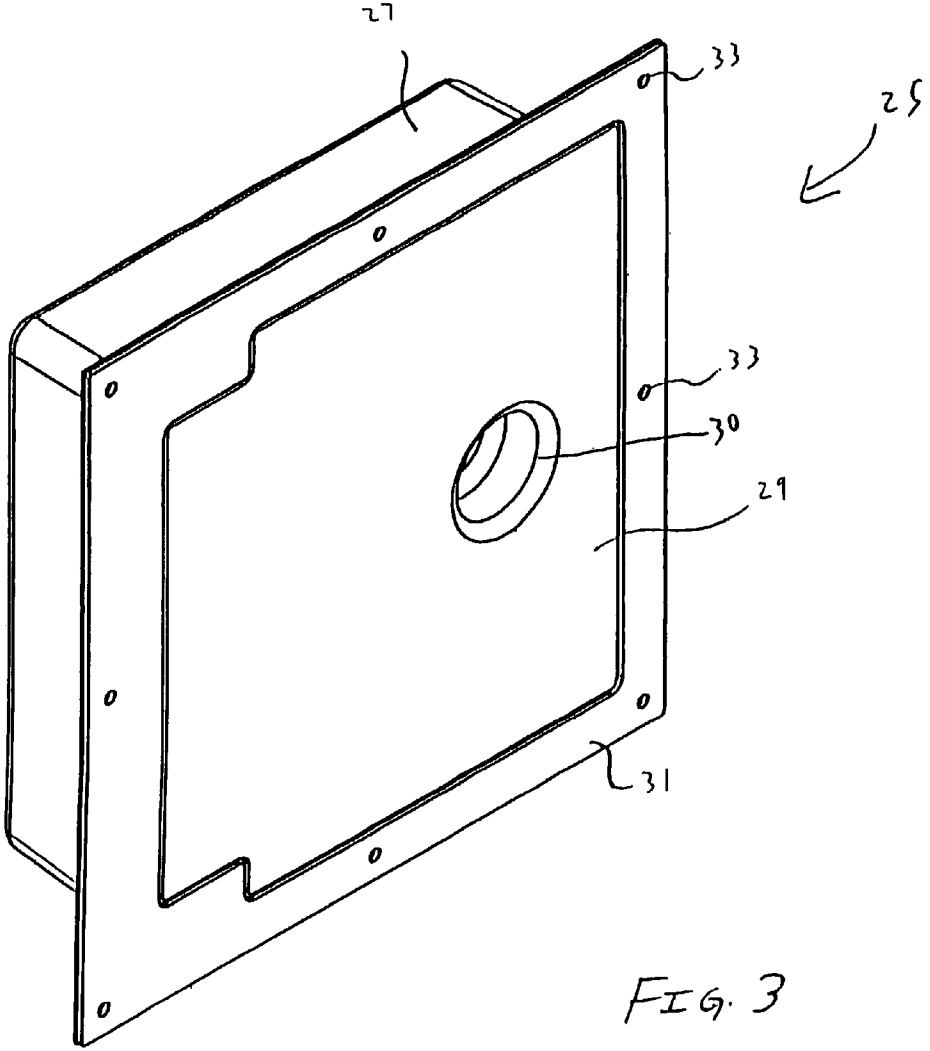
FIG. 3 is a front perspective view of the wall hydrant box of FIG. 2 with drilled out holes.
Figure 4:
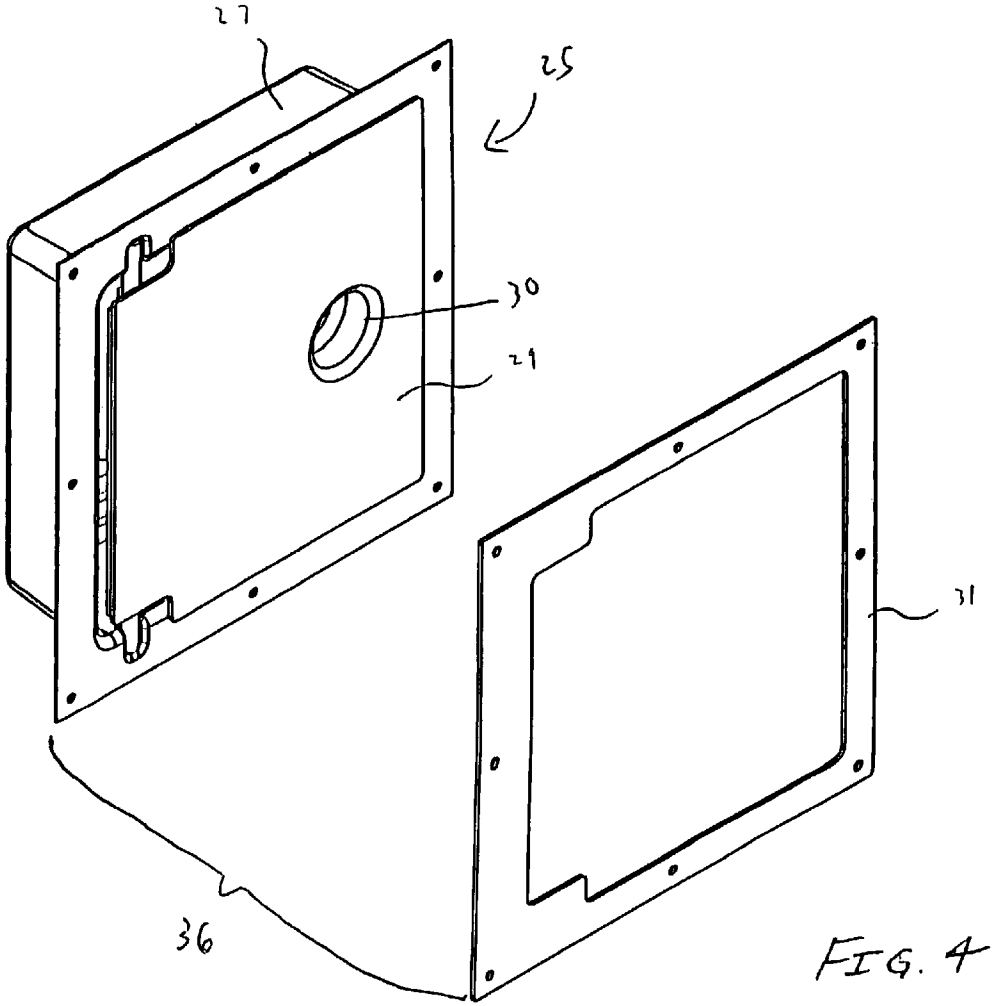
FIG. 4 is a front perspective view of the wall hydrant box of FIG. 2 showing the existing face plate removed.

With reference to FIGS. 3 and 4, and with continuing reference to FIG. 2, face plate 31 can be removed from the box 27 by drilling holes 33 into spot welds (not shown). Thereafter, face plate 31 is removed from the front of box 27.

Figure 5:
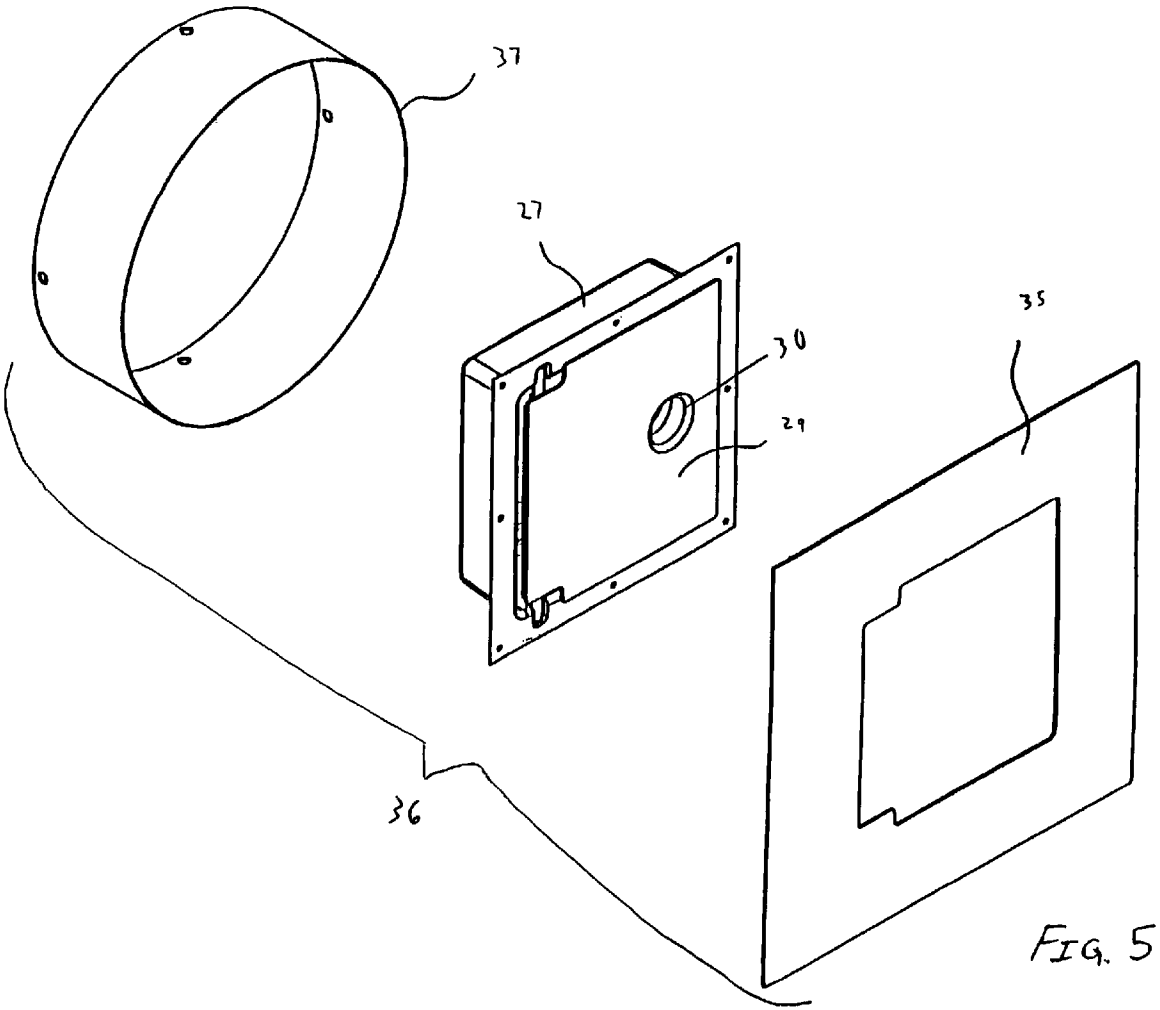
FIG. 5 is a front perspective view of the wall hydrant box of FIG. 2 showing a unitary front plate and a ring prior to mounting onto the hydrant box.
Figure 6:
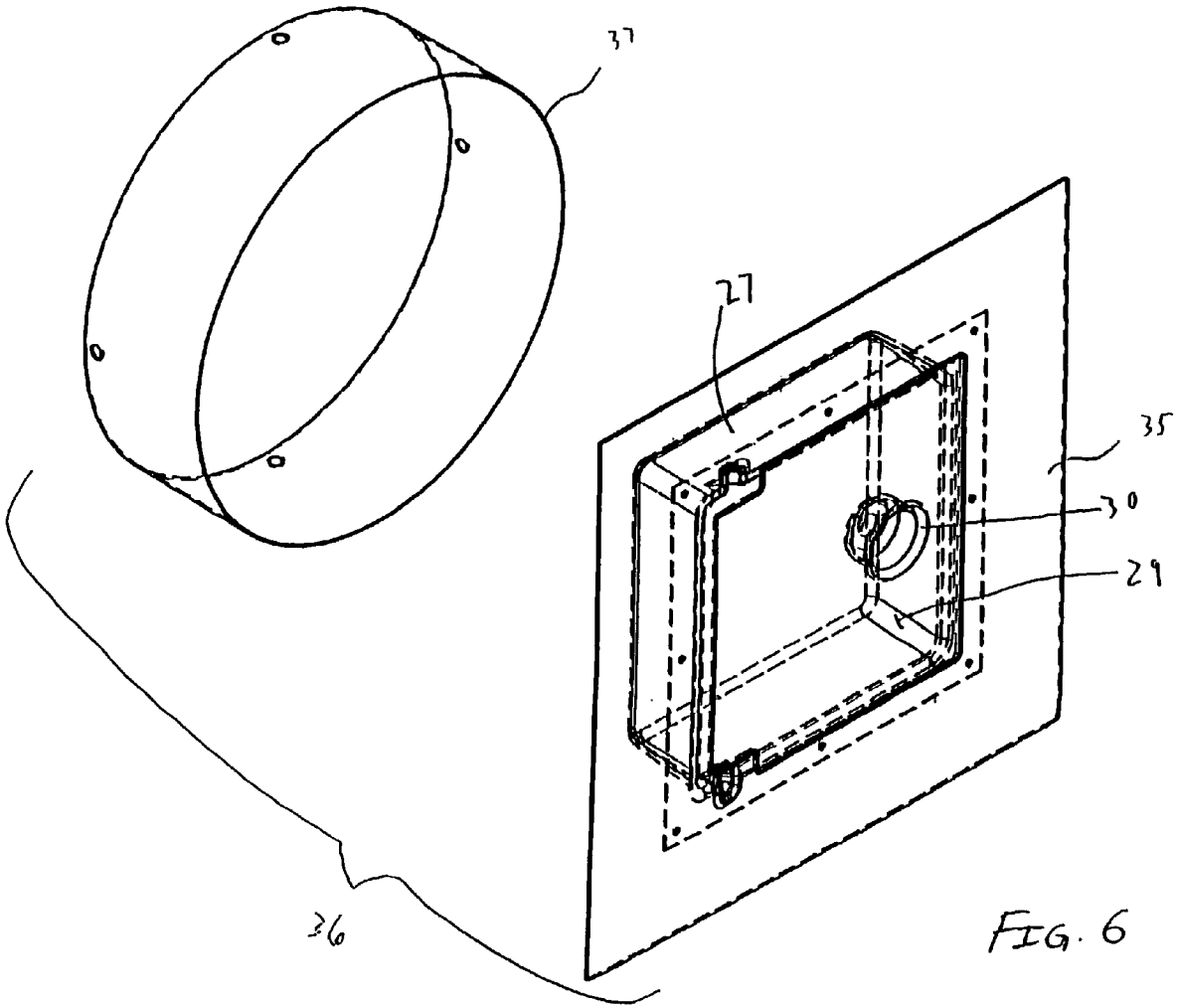
FIG. 6 is a front perspective view of the wall hydrant box of FIG. 2 having the unitary front plate welded thereon.

With reference to FIGS. 5 and 6, and with continuing reference to FIGS. 2-4, once face plate 31 is removed, a unitary front plate 35, along with an optional ring 37, can be added to box 27 to form a wall hydrant box with a unitary frame 36. Unitary front plate 35 is positioned adjacent to the front of box 27 and is welded thereon. Ring 37 is welded to the rear of box 27 to allow wall hydrant box 25 to be secured within a wall and for receiving the wall hydrant. Cover 29, unitary front plate 35 and ring 37 may all be constructed of stainless steel. Unitary front plate 35 is substituted for face plate 18 and frame 21 of the prior art hydrant box, thereby providing a uniform and aesthetic look to the front of the wall hydrant box.

Figure 7:
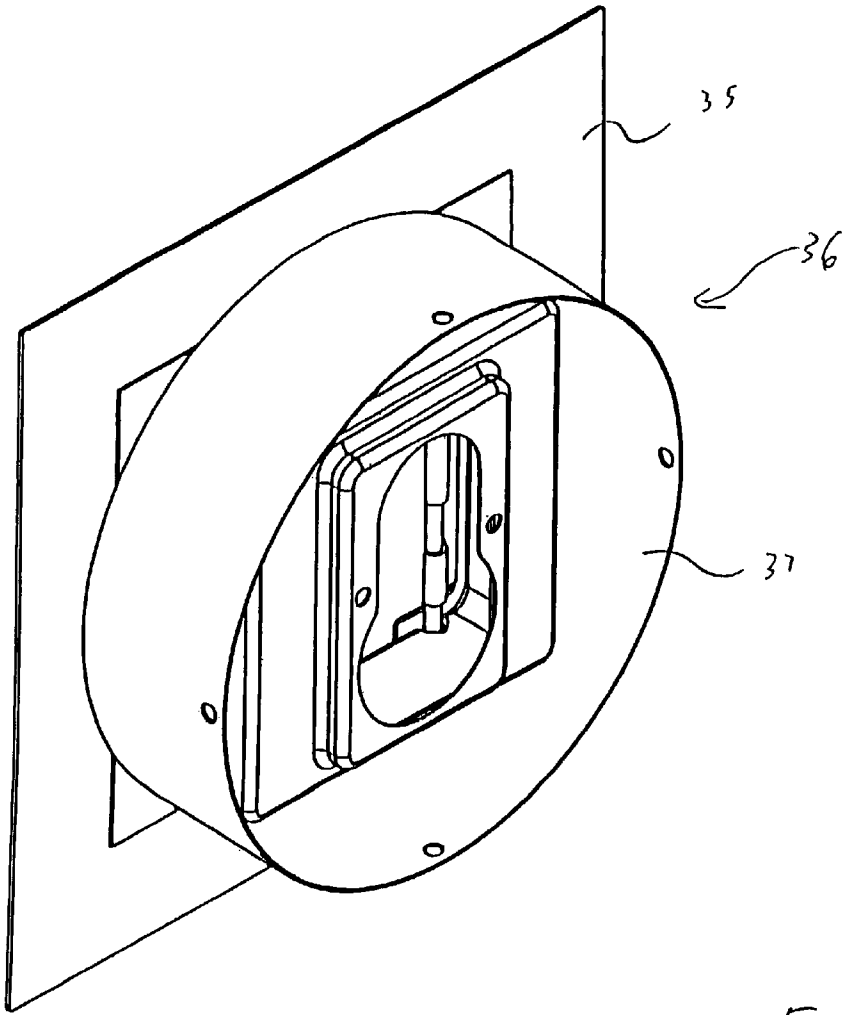
FIG. 7 is a rear perspective view of the wall hydrant box of FIG. 2 having the ring welded to the wall hydrant box.

With reference to FIG. 7, and with continuing reference to FIGS. 5 and 6, portions of ring 37 extend beyond box 27. When viewed from the front, the portions of ring 37 that extend beyond box 27 are hidden from view by unitary front plate 35. It is to be understood that any other supporting structure may be substituted for ring 37.

While the present invention was described with reference to preferred embodiments of the wall hydrant box, those skilled in the art may make modifications and alterations to the present invention without departing from the scope and spirit of the invention. Accordingly, the above detailed description is intended to be illustrative rather than restrictive. The invention is defined by the appended claims, and all changes to the invention that fall within the meaning and range of equivalency of the claims are to be embraced within their scope.

The invention claimed is:

1. A wall hydrant box comprising:

a box including a front side and a rear side;

a cover mounted on the front side of the box;

a ring welded onto the rear side of the box, at least a portion of the ring extends beyond the box; and a unitary frame welded onto the front side of the box such that the unitary frame covers at least a portion of the front side of the box, wherein the unitary frame is constructed from a single piece of material that is sufficiently sized to obscure the ring when viewed from the front side of the box.

2. The wall hydrant box of claim 1, wherein the cover includes an operating key lock.

3. The wall hydrant box of claim 1, wherein the cover includes a descriptive label.

4. The wall hydrant box of claim 1, wherein the box accommodates a wall hydrant.

5. The wall hydrant box of claim 1, wherein the cover is hinged to allow access to a wall hydrant.

6. The wall hydrant box of claim 1, wherein the box, cover, and unitary front plate are constructed of stainless steel.

7. The wall hydrant box of claim 1, wherein the ring is constructed of stainless steel.

* * * * *